US010272981B2

(12) United States Patent
Caccia et al.

(10) Patent No.: US 10,272,981 B2
(45) Date of Patent: Apr. 30, 2019

(54) WATERCRAFT

(71) Applicants: Alex Caccia, Oxford (GB); Adrian Thomas, Oxford (GB)

(72) Inventors: Alex Caccia, Oxford (GB); Adrian Thomas, Oxford (GB)

( * ) Notice: Subject to any disclaimer, the term of this patent is extended or adjusted under 35 U.S.C. 154(b) by 72 days.

(21) Appl. No.: 15/537,483

(22) PCT Filed: Dec. 17, 2015

(86) PCT No.: PCT/GB2015/054053
§ 371 (c)(1),
(2) Date: Jun. 19, 2017

(87) PCT Pub. No.: WO2016/097741
PCT Pub. Date: Jun. 23, 2016

(65) Prior Publication Data

US 2017/0361903 A1 Dec. 21, 2017

(30) Foreign Application Priority Data

Dec. 18, 2014 (GB) ..... 1422645.0

(51) Int. Cl.
*B63B 1/24* (2006.01)
*B63B 1/28* (2006.01)
(Continued)

(52) U.S. Cl.
CPC ..... *B63H 16/12* (2013.01); *B63B 1/246* (2013.01); *B63B 1/28* (2013.01); *B63B 1/285* (2013.01);
(Continued)

(58) Field of Classification Search
CPC ..... B63B 1/246; B63B 1/28; B63B 1/285; B63H 2016/005; B63H 16/12;
(Continued)

(56) References Cited

U.S. PATENT DOCUMENTS 515,682 A * 2/1894 Hoeft ..... B63H 16/12 440/27
871,059 A * 11/1907 Douse ..... F04D 33/00 416/81
(Continued)

FOREIGN PATENT DOCUMENTS

CN 101973384 2/2011
DE 2840411 A1 4/1980
(Continued)

OTHER PUBLICATIONS

International Search Report issued in PCT/GB2015/054053, dated Jun. 1, 2016.

*Primary Examiner* — Ajay Vasudeva
(74) *Attorney, Agent, or Firm* — Heslin Rothenberg Farley & Mesiti P.C.; Stephen Scuderi

(57) ABSTRACT

A watercraft includes a chassis, a drive, a hydrofoil and a drive transfer arm. The drive is operatively connected to a first end of the drive transfer arm. The hydrofoil is pivotably connected to a second end of the drive transfer arm. The watercraft is configured such that operation of the drive causes the hydrofoil to oscillate, to provide thrust. The hydrofoil is pivotably connected to the second end of the drive transfer arm with an adjustable connection mechanism. The adjustable connection mechanism is such that the distance between a leading edge of the hydrofoil and a rotational axis of a pivoting connection point to the drive transfer arm is adjustable.

18 Claims, 6 Drawing Sheets

(51) Int. Cl.

| | |
|---|---|
| ***B63B 35/73*** | (2006.01) |
| ***B63H 16/08*** | (2006.01) |
| ***B63H 16/00*** | (2006.01) |
| ***B63H 16/20*** | (2006.01) |

(52) U.S. Cl.
CPC ..... *B63B 35/73* (2013.01); *B63B 35/731* (2013.01); *B63H 16/20* (2013.01); *B63H 2016/005* (2013.01); *B63H 2016/202* (2013.01)

(58) Field of Classification Search
CPC ..... B63H 16/14; B63H 16/18; B63H 16/20; B63H 2016/202
See application file for complete search history.

(56) References Cited

U.S. PATENT DOCUMENTS 4,576,580 A * 3/1986 Gulko ..... B63H 1/36 440/21
5,127,855 A * 7/1992 Heywood ..... B63H 16/12 440/14
7,021,232 B2 * 4/2006 Chen ..... B63B 1/246 114/274
7,662,004 B1 2/2010 March et al.
8,986,057 B2 * 3/2015 Catarina ..... B63B 1/12 440/21
9,522,719 B1 * 12/2016 Yonover ..... B63H 1/36

FOREIGN PATENT DOCUMENTS

| | | | |
|---|---|---|---|
| FR | 2565549 | A1 | 12/1985 |
| JP | H11291984 | A | 10/1999 |
| KR | 100759593 | B1 | 9/2007 |
| WO | 1997029010 | | 8/1997 |
| WO | 2008039103 | A1 | 7/2008 |
| WO | 2012021954 | A1 | 2/2012 |

* cited by examiner

WATERCRAFT

CROSS REFERENCE TO RELATED APPLICATIONS

This application is the National Phase filing under 35 U.S.C. § 371 of International Application No. PCT/GB2015/054053, filed on Dec. 17, 2015, and published on Jun. 23, 2016 as WO/2016/097741A1, and claims priority to Great Britain Application No. 1422645.0, filed on Dec. 18, 2014. The contents of each of the prior applications are hereby incorporated by reference herein in their entirety.

BACKGROUND

The present invention relates to a watercraft.

Many different types of watercraft are known, which adopt various means of propulsion. The propulsion may be provided by an engine, sail or manually provided by a user. Examples of such manual propulsion means are paddles or oars. In a traditional rowing boat, a seated rower, facing away from the direction of travel, pulls on one or two oars, which serves to pull the boat through the water using a lever action. The oars/paddles provide thrust to carry the watercraft through the water.

Other known watercraft are powered by the use of a single oar extending from the stern of the boat (e.g. a gondola). The watercraft is propelled through the water by the oarsman paddling the oar from side to side.

Various manually propelled watercraft are known from CN101973384, JPH11291984, FR2565549, DE2840411 and WO2012021954.

The present invention seeks to provide an alternative watercraft.

BRIEF DESCRIPTION

Accordingly, the present invention provides a watercraft comprising:

a chassis;

a drive means;

a hydrofoil; and a drive transfer arm, wherein the drive means is operatively connected to a first end of the drive transfer arm, and the hydrofoil is pivotably connected to a second end of the drive transfer arm, the watercraft configured such that operation of the drive means causes the hydrofoil to oscillate, to provide thrust.

Preferably, the watercraft is configured such that operation of the drive means causes the hydrofoil to oscillate, to provide both thrust and vertical lift.

Preferably, the hydrofoil is pivotably connected to the second end of the drive transfer arm with an adjustable connection mechanism, wherein the distance between the leading edge of the hydrofoil and the rotational axis of the pivoting connection point to the drive transfer arm is adjustable.

Preferably, the watercraft further comprises a control member, operable to adjust the distance between the leading edge of the hydrofoil and the rotational axis of the pivoting connection point to the drive transfer arm.

Preferably, the drive means are rotary drive means.

Preferably, the drive means are manually operated by the user of the watercraft.

Preferably, the manual drive means include a crankset provided with pedals.

Preferably, the drive means further includes a drive wheel operatively connected to the crankset, wherein the drive wheel is operatively connected to the first end of the drive transfer arm.

Preferably, the watercraft further comprises a gear arrangement between the drive wheel and the crankset.

Preferably, the watercraft is configured such that for each complete revolution of a pedal about the crankset, the hydrofoil completes two oscillation cycles.

Preferably, the drive means is a rotary drive means, and the watercraft further comprises a connecting rod, wherein a first end of the connecting rod is pivotably connected to the rotary drive wheel at a predetermined distance from the axis of rotation of the rotary drive wheel, and the second end of the connective rod is pivotably connected to the first end of the drive transfer means, wherein rotation of the rotary drive wheel causes the second end of the drive arm to prescribe said arcuate path.

Preferably, the drive means comprises a motor.

Preferably, the hydrofoil is substantially pitch stable.

Preferably, the hydrofoil comprises at least one controllable flap.

Preferably, the drive transfer arm is pivotably secured to the chassis, such that the second end of the drive transfer arm prescribes an arcuate path in use.

Preferably, the watercraft further comprises a support arm rigidly connected at a first section to the drive transfer arm is pivotably connected at a second section to the chassis, such that the drive transfer arm is rotatable about an axis passing through the pivoting connection of the support arm to the chassis.

Preferably, the watercraft further comprises a spring operatively connected between the chassis and the first end of the drive arm.

Preferably, the rotation of the hydrofoil relative to the longitudinal axis of the drive transfer arm is limited to within a predetermined range.

Preferably, the hydrofoil is a self-stable reflexed hydrofoil.

Preferably, the hydrofoil has a non-uniform angle of incidence across its span.

Preferably, the watercraft further comprises a seat for a user, mounted on the chassis.

Preferably, the seat is arranged to allow the user to sit in a recumbent position.

Preferably, the watercraft further comprises at least one auxiliary hydrofoil attached to the chassis, for providing additional lift.

Preferably, the watercraft further comprises.

Preferably, the watercraft is configured such that the inclined plane swept by the hydrofoil in use, on the downwards stroke, follows a path which is substantially twice as steep as the lift-to-drag ratio of the watercraft when gliding through a fluid.

DRAWINGS

Embodiments of the present invention will now be described, by way of non-limiting examples only, with reference to the figures in which.

DETAILED DESCRIPTION

Figure 1:
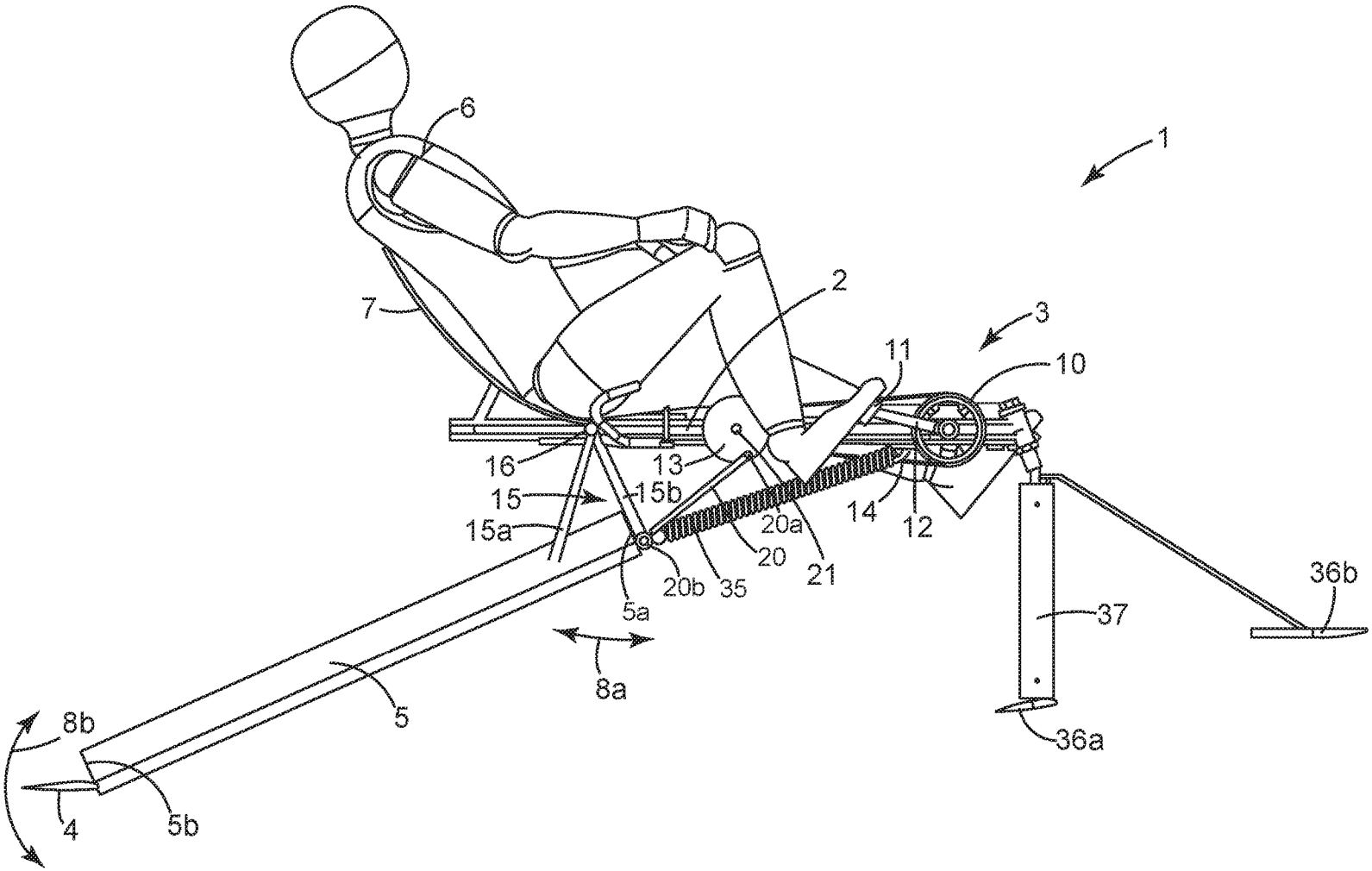
FIG. 1 illustrates a watercraft according to an embodiment of the present invention.

FIG. 1 illustrates a watercraft 1 embodying the present invention. The watercraft 1 comprises a chassis 2, drive means 3 and a hydrofoil 4. The watercraft 1 further comprises a drive transfer arm 5. The drive means 3 is operatively connected to a first end 5*a* of the drive transfer arm 5. The hydrofoil 4 is pivotably connected to a second end 5*b* of the drive transfer arm 5.

As will be described in further detail below, the watercraft 1 is preferably configured such that the operation of the drive means 3 causes the hydrofoil 4 to vertically oscillate, to provide both thrust (propulsion) and vertical lift to the watercraft 1. In other embodiments, described later, the hydrofoil is only adopted to provide propulsion. In all embodiments, the direction of the propulsion is preferably substantially parallel to the surface of the water.

In the embodiment shown in FIG. 1, the drive means 3 comprises rotary drive means. The drive means 3 are manually operated by a user 6 of the watercraft 1. A seat 7 is connected to the chassis 2. Preferably, the watercraft 1 is configured such that the user 6 can sit in the seat 7 in a recumbent position. A recumbent seating position is preferred but not essential. In other embodiments, other seating positions may be adopted, including an upright position.

As illustrated in FIG. 1, the drive means 3 comprises a crankset 10 provided with pedals 11. Preferably, the crankset 10 comprises two crank arms 12, each provided with a pedal 11 at a distal end thereof. Preferably, the longitudinal axes of each crank arm 12 are parallel to one another, such that the crank arms 12 are arranged 180° with respect to one another. The pedals 11 are pivotably connected to the distal end of the crank arms 12 in a conventional manner. The drive means 3 further preferably includes a drive wheel 13 operatively connected to the crankset 10. Preferably, the drive wheel 13 is operatively connected to the crankset 10 by means of a chain 14 or a belt etc. A gearing arrangement is preferably provided between the drive wheel 13 and the crankset 10. The gearing arrangement may be provided by configuring each of the drive wheel 13 and crankset 10 to have a different diameter. Other gearing mechanisms are possible. In another embodiment, there may be no chain/belt provided, and the crankset and drive wheel may be operatively connected in other ways. For example, both the crankset and drive wheel may be provided with teeth which directly mesh with one another, or comprise part of a larger gear train.

In the embodiment shown, the drive wheel 13 is operatively connected to a first end 5*a* of the drive transfer arm 5, as will be described in more detail below.

In an another embodiment, rather than provide a separate crankset 10 and drive wheel 13 with optional gearing therebetween, the drive means 3 may comprise a drive wheel to which the pedals are directly attached, thus providing a direct drive arrangement. In the embodiment shown, the use of a chain/belt is used in part so as to transfer the rotary motion from the crankset 10 to a rearward position, where the drive wheel 13 is located. In applicable embodiments, a gearbox may be provided between the drive means and the drive wheel 13.

A support arm 15 is rigidly connected at a first section, adjacent the first end 5*a*, of the drive transfer arm 5. In the embodiment shown, there are two support arms 15*a*, 15*b*. The support arm(s) is pivotably connected at a second end to the chassis 2, such that the drive transfer arm 5 is rotatable about an axis 16 passing through the pivoting connection of the support arm 15 to the chassis 2. In the embodiment shown, both support arms 15*a*, 15*b* terminate at the same point as the axis 16 of rotatable connection to the chassis. It is to be noted from FIG. 1 that the longitudinal axis of the drive transfer arms 5 does not pass through the axis 16 about which the drive transfer arm 5 is rotatable. Accordingly, when the drive transfer arm 5 is rotated about the axis 16, both the first 5*a* and second 5*b* ends at the drive transfer arm 5 prescribe arcuate paths 8*a* and 8*b* respectively.

The watercraft 1 further comprises a connecting rod 20. A first end 20*a* of the connecting rod 20 is pivotably connected to the rotary drive wheel 13 at a predetermined distance from the axis of rotation 21 of the rotary drive wheel 13. The second end 20*b* of the connecting rod 20 is pivotably connected to the first end 5*a* of the drive transfer means 5. The connecting rod 20 effectively transforms the rotary motion of the drive wheel 13 into a substantially linear motion at the end 20*b* of the connecting rod 20. However, by virtue of the drive transfer arm 5 being pivotably connected to the chassis 2 via support arm 15, the end 20*b* of the connecting rod 20 is constrained to follow an arcuate path 8*a*, about the axis 16 of rotation. The connecting rod 20 therefore converts rotational motion of the drive wheel 13 into an oscillating arcuate motion.

As noted above, the watercraft 1 illustrated in FIG. 1 causes the second end 5*b* of the drive transfer arm 5 to describe an oscillating arcuate path 8*b*, in a vertical plane. Since the distance from the axis 16 to the distal end 5*b* of the drive transfer arm 5 is greater than the distance from the axis 16 to the first end 5*a* of the drive transfer arm 5, the arcuate path 8*b* described by the second end 5*b* is longer than the path 8*a* prescribed by the first end 5*a*.

The motion of the second end 5*b* of the drive transfer arm 5 causes a corresponding vertically oscillating "flapping" motion of the hydrofoil 4.

Preferably, the watercraft 1 is configured such that for each complete revolution of a respective pedal 11 about the rotational axis of the crankset 10, the hydrofoil 5 completes two oscillation cycles. A particular benefit of this arrangement is that the hydrofoil 'flaps' downwards for every downwards stroke of each of the user's respective legs. This may be achieved with a 2:1 gearing ratio between the crankset 10 and the drive wheel 13.

Figure 2:
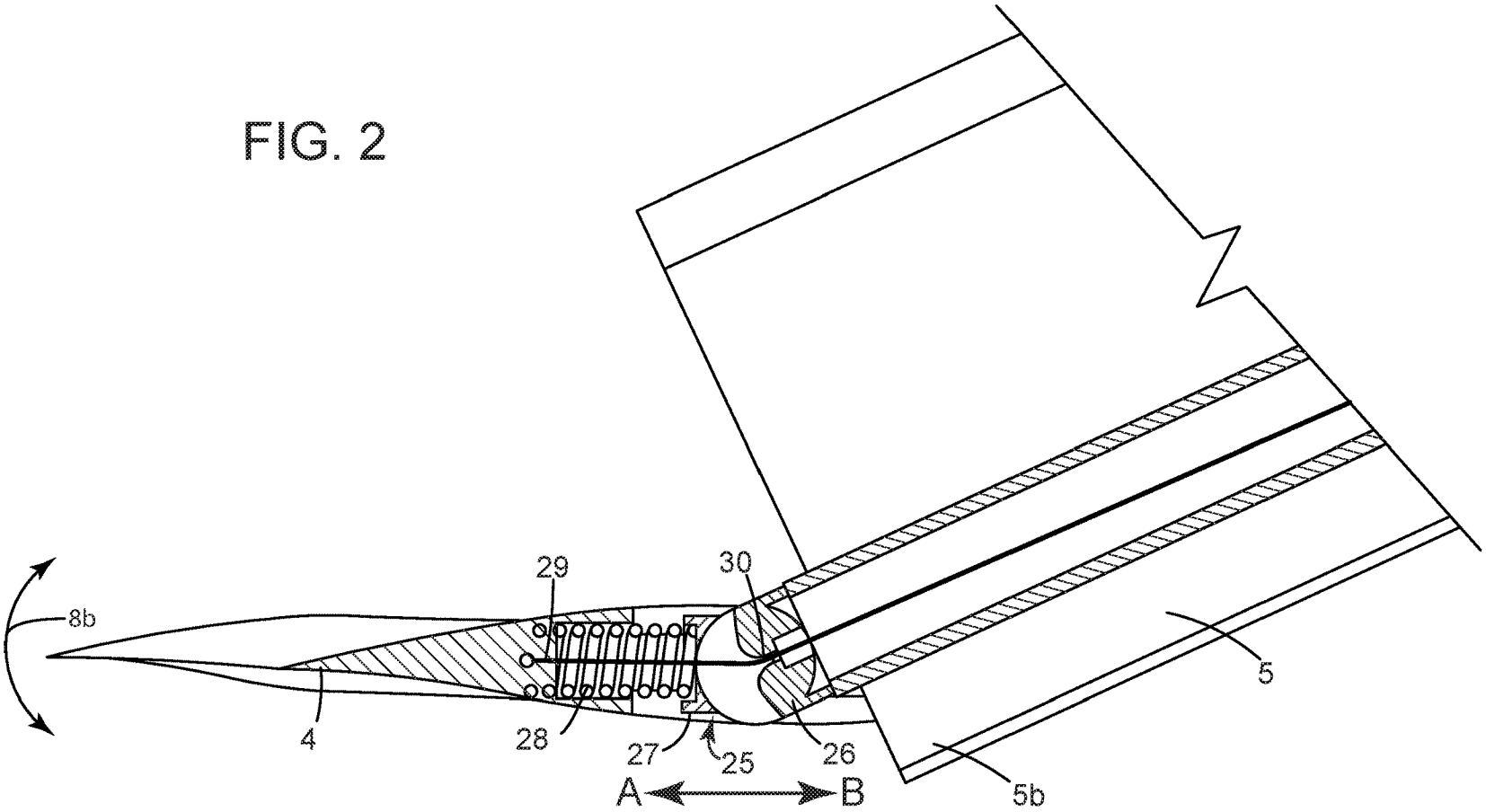
FIG. 2 illustrates an enlarged partial cross-section of the connection mechanism between the drive transfer arm and the hydrofoil of a watercraft embodying the present invention.

An enlarged, cross-sectional, view of the pivoting connection between the drive transfer arm 5 and the hydrofoil 4 is illustrated in FIG. 2. In the embodiment shown, an adjustable connection mechanism 25 is provided between the drive transfer arm 5 and the hydrofoil 4. As is known, the hydrofoil 4, as with any foil, has a dynamic centre, in this case a hydrodynamic centre, where the pitching moment coefficient for the foil does not vary with the lift coefficient (i.e. the angle of attack). The hydrodynamic centre of the hydrofoil 4 is not illustrated in FIG. 2.

With reference to FIG. 2, the hydrofoil 4 is pivotably connected to the second end 5*b* of the drive transfer arm 5 about an axis of rotation 30. Preferably, the hydrofoil 4 is substantially pitch stable.

The connection mechanism 25 comprises a male member 26 provided at the second end 5*b* of the drive transfer arm 5, which is received in a female part 27 provided in a part of the hydrofoil 4. At least a part of the surface of the male member 26 may be substantially cylindrical, which is received in a corresponding cup surface of the female part 27. Furthermore, the connection mechanism 25 comprises a spring 28 received in an aperture within the aerofoil 4. The spring 28 provides a biasing force on the male member 26 of the connection mechanism 25, urging it towards the leading edge of the hydrofoil 4. The connection mechanism 25 further comprises a control member, in this embodiment a control wire 29, which passes through the centre of the drive transfer arm 5 and is operatively connected to a control lever (not shown), or equivalent, on the chassis 2, for use by the user 6. The lower end of the control member 29 is received within the hydrofoil 4. As the control member 29 is tensioned in use, the tension force opposes the biasing force of the spring 28. As a result, the position of the male member 26 of the connection mechanism 25, and thus the axis of rotation 30 is adjusted by adjusting the control member 29. A benefit of this arrangement is that it enables the user to alter the angle of attack of the hydrofoil 4, and therefore "tune" the behaviour of the hydrofoil 4 to the speed of travel. For example, the user 6 may decrease the angle of attack as the speed of the watercraft increases, and increase the angle of attack as the speed of the watercraft decreases.

Other methods of adjusting the position of the pivot point along the chord of the hydrofoil are possible. An alternative pivoting connection is shown in FIGS. 4 to 6.

Figure 4:
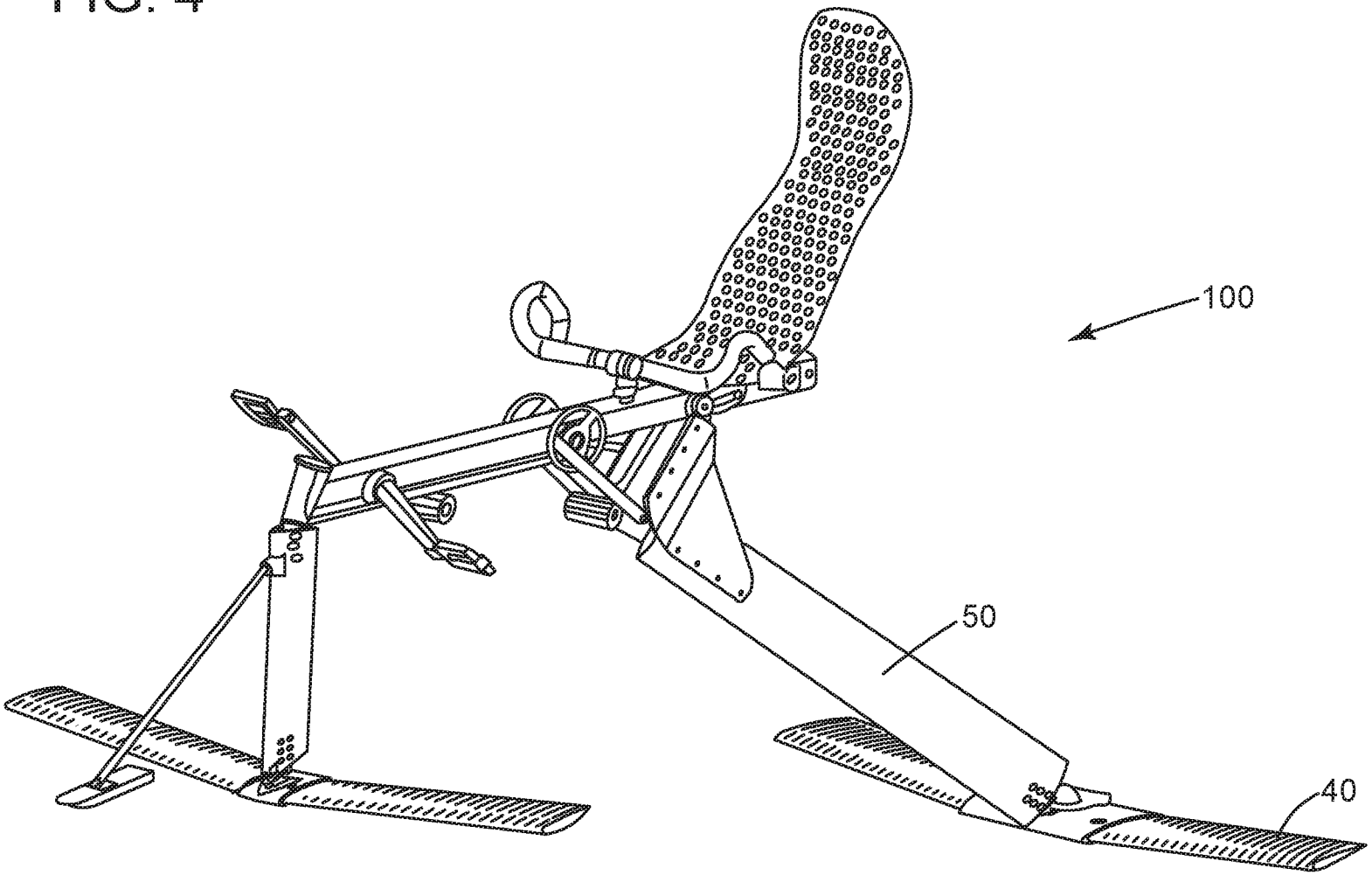
FIG. 4 illustrates another watercraft embodying the present invention.
Figure 5:
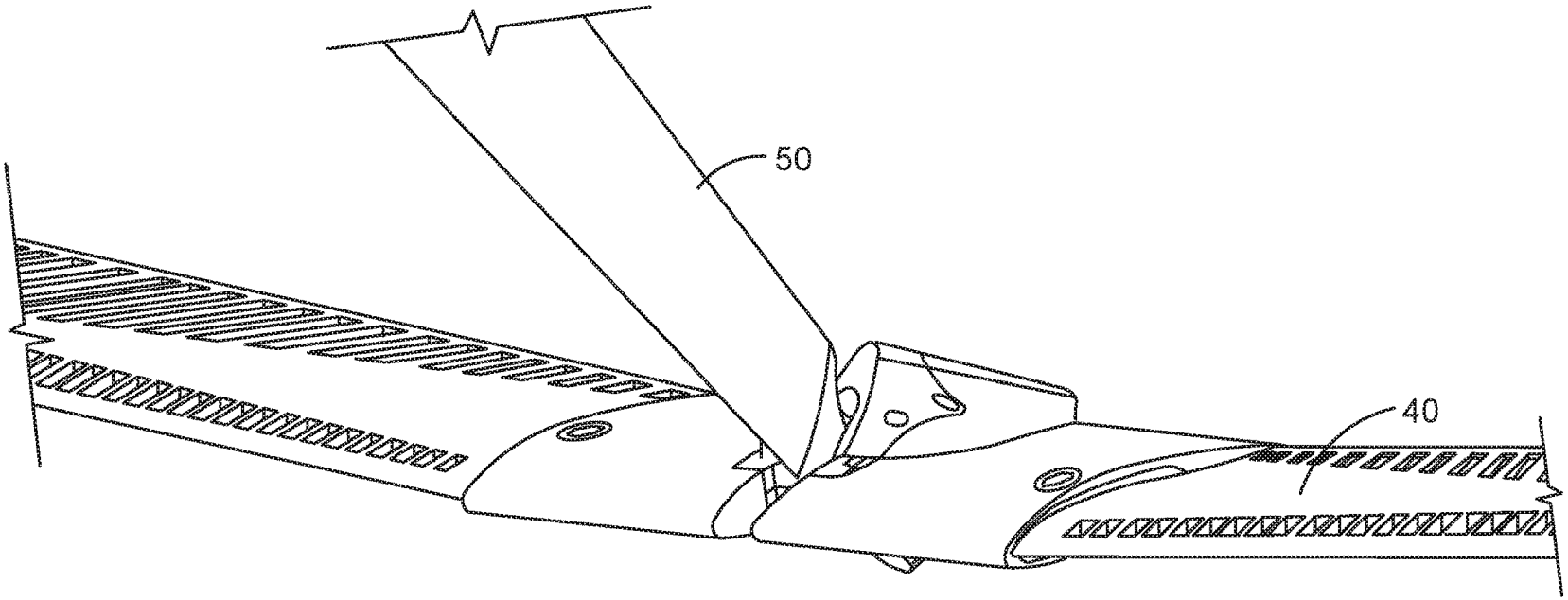
FIG. 5 illustrates the hydrofoil of the watercraft in FIG. 4.
Figure 6:
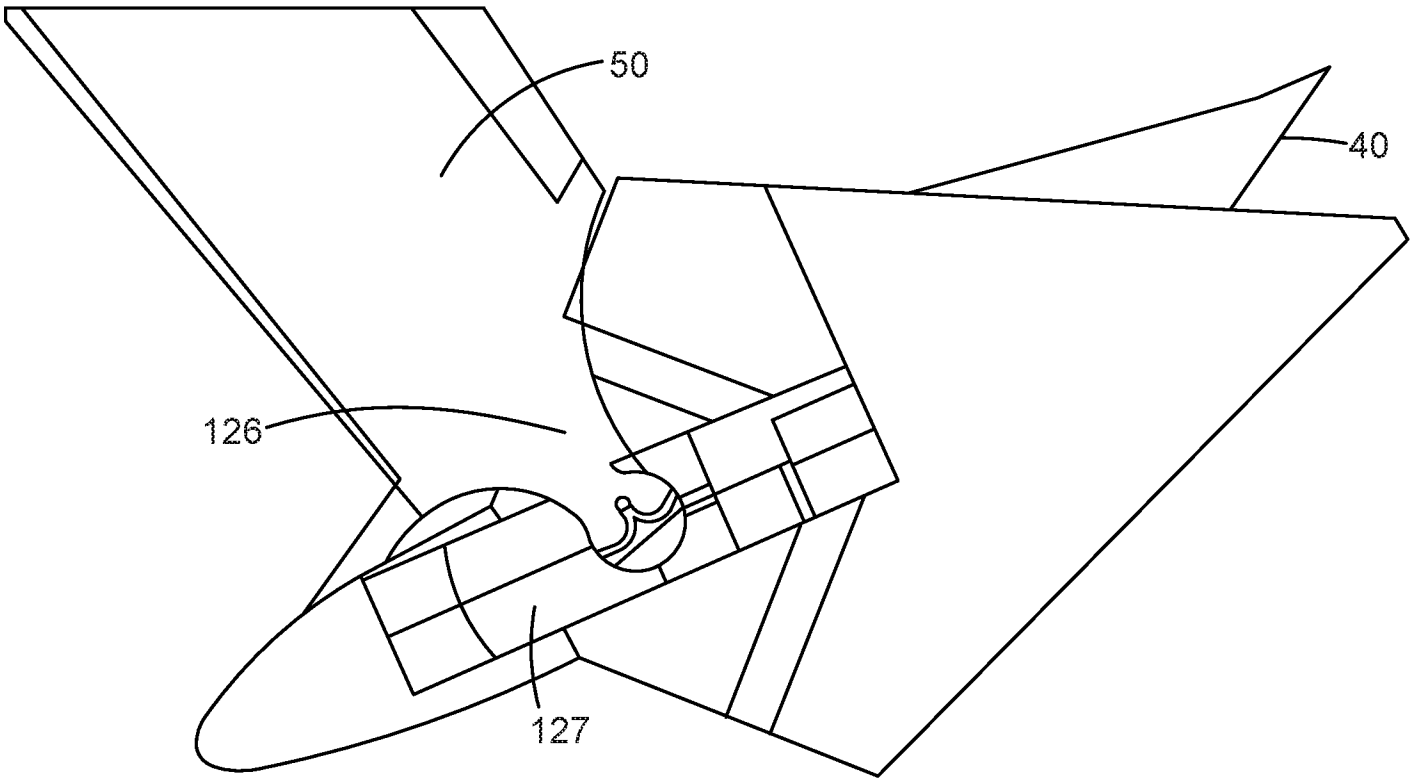
FIG. 6 illustrates a cross-section of the hydrofoil of FIG. 5.

In the embodiment in FIGS. 4-6, the watercraft 100 has a rear drive hydrofoil 40 foil that is self-stable due to washout, and where the position of the fulcrum can be adjusted fore and aft to adjust the mean angle of attack during the stroke for higher or lower speeds, or for higher or lower accelerations.

The fulcrum connection between the hydrofoil 40 and drive transfer arm 5 is shown in FIG. 5. The connection is designed to allow the fulcrum to move fore-and-aft relative to the leading edge of the hydrofoil 40.

As shown in FIG. 6, a male member 126 provided at the second end 5*b* of the drive transfer arm 50 is received in a female part 127 provided by a carriage which is translatably received in the central part of the hydrofoil 40. The carriage 127 is operable to translate relative to the chord of the hydrofoil 40, thus changing the location of the pivot point along the chord, and thus the distance between the pivot point and the leading edge. The position of the female part 127 (and thus the fulcrum) relative to the leading edge may be adjusted by a control wire and biasing springs, as with the arrangement illustrated in FIG. 2. The wire passes into the drive transfer arm 50 through a groove that has a cycloid profile, and up the drive transfer shaft to a gear shift so the pilot can set the position of the fulcrum.

In another embodiment, rather than provide the user with the ability to adjust the position of the pivot point in use, the position of the pivot point may either be fixed, or only adjustable when the watercraft is not in service. For example, a webbing strap may protrude from the second end 5*b* of the drive transfer arm 5, and be provided with a pin which is receivable on a rack provided on the central section of the hydrofoil. The position of the pin in the rack on the hydrofoil determines the position of the pivot point and thus the mean angle of attack. The position of the pin can be manually set before use. Alternatively, the webbing may be fixed to the hydrofoil, and the rack may be provided on the drive transfer arm, achieving the same result.

In the embodiment shown, the pitch stability of the hydrofoil is provided by adopting a swept wing profile with washout. In another embodiment, pitch stability is achieved by using a pitch-stable reflexed hydrofoil section (without the need for a swept profile).

The pitch stability gives a hydrodynamic centre about which the pitching moments are stable and zero. The pivot at the end of the drive shaft is attached such so that the pitching moments about the pivot are identically stable and zero at a given mean angle of attack for the hydrofoil as a whole. Preferably, the hydrodynamic centre is substantially aligned with the axis 30.

Moving the pivot point forwards changes the angle of attack of the hydrofoil, and thus moves the system to a different stable state with a new hydrodynamic centre. Moving the pivot forwards gives a lower mean angle of attack. Moving the pivot further aft gives a higher mean angle of attack.

The mean angle of attack depends on the position of the pivot point (fulcrum) along the chord of the hydrofoil and the stability of the hydrofoil. For a substantially stable hydrofoil, the position of the pivot point determines the stable mean angle of attack.

A pitch stable hydrofoil allows the hydrofoil to adopt an angle of attack relative to the flow, and return to that angle of attack following perturbations from turbulence or unsteady movements.

Rather than provide pitch stability through the use of a swept wing profile with washout or a reflexed hydrofoil section, the hydrofoil may be provided with adjustable flaps/ailerons, preferably on the trailing edge of the hydrofoil. The flaps may only extend along a portion of the trailing edge of the hydrofoil. Preferably, there are a plurality of flaps, which are symmetrical in form and location relative to the central fore-aft axis of the hydrofoil. The angle of the flaps relative to the main surface of the hydrofoil and/or angle of incidence is adjustable so as to provide the hydrofoil with reflex or washout.

Alternatively, the flaps may be provided on a hydrofoil having a swept wing profile with no base washout (i.e. a symmetric hydrofoil throughout, and with the aerofoils in the tips at the same angle of attack as the aerofoils at the wing centreline). In this embodiment, the flaps may be used to generate washout so that the pitch stability forces the hydrofoil to adopt a positive stable mean angle of attack positive (nose up, tip flaps up, centreline flaps down) or mirror-image configuration in which the pitch stability forces the hydrofoil to adopt a negative stable mean angle of attack (nose down, tip flaps down, centre flaps up).

With reference to FIG. 1, the watercraft 1 may further comprise a suspension spring 35 which is operatively connected between the chassis 2 and the junction of the first end 5*b* of the drive transfer arm 5 and second end 20*b* of the connecting rod 20. The spring 35 is preferably a tension spring. Accordingly, the force imposed by the spring 35 urges the first end 5*a* of the drive transfer arm to move about the rotational axis 16 in an anti-clockwise direction. In so doing, the spring 35 effectively urges the hydrofoil 4 down to its lowest extent of the arcuate path. The spring 35 thereby provides a suspension system, to carry the weight of the craft and the user, such that a higher proportion of the user's applied force is used to generate thrust, rather than to counteract the watercraft and the pilot's combined weight.

The spring 35 is preferably configured to support the weight of the user, rather than to 'recover' the position of the foil after movement by the user. By comparison, the spring in JPH11291984 and FR2565549 is provided to assist the recovery stroke.

In one embodiment, the rotation of the hydrofoil 4 relative to the longitudinal axis of the drive transfer arm 5 is limited to within a predetermined range. In one embodiment, the range is substantially 45 degrees.

The hydrofoil 4 is preferably a self-stable reflexed hydrofoil. The hydrofoil 4 preferably has a non-uniform angle of incidence across its span. In one embodiment, the hydrofoil has a non-uniform angle of incidence across its span, combined with sweep. In another embodiment, the hydrofoil is a reflexed hydrofoil.

Preferably, the watercraft 1 further comprises at least one auxiliary hydrofoil 36*a*, 36*b* to provide additional lift (but not thrust) to the watercraft 1. Furthermore, the watercraft 1 preferably comprises a rudder 37, as illustrated in FIG. 1. In FIG. 1, one auxiliary hydrofoil 36*a* is provided at the bottom of the rudder 37, but this is not essential. The rudder 37 is preferably operatively connected to a steering mechanism (not shown) for operation by the user 6. The drive transfer arm 5 additionally or alternatively includes a rudder element.

Preferably, the watercraft is configured such that the inclined plane swept by the hydrofoil in use, on the downward stroke, follows a path which is substantially twice as steep as the lift-to-drag ratio of the watercraft when gliding through a fluid. Preferably, the cruise velocity is substantially three times greater than the product of the frequency and amplitude of the motion of the hydrofoil 4.

Figure 3:
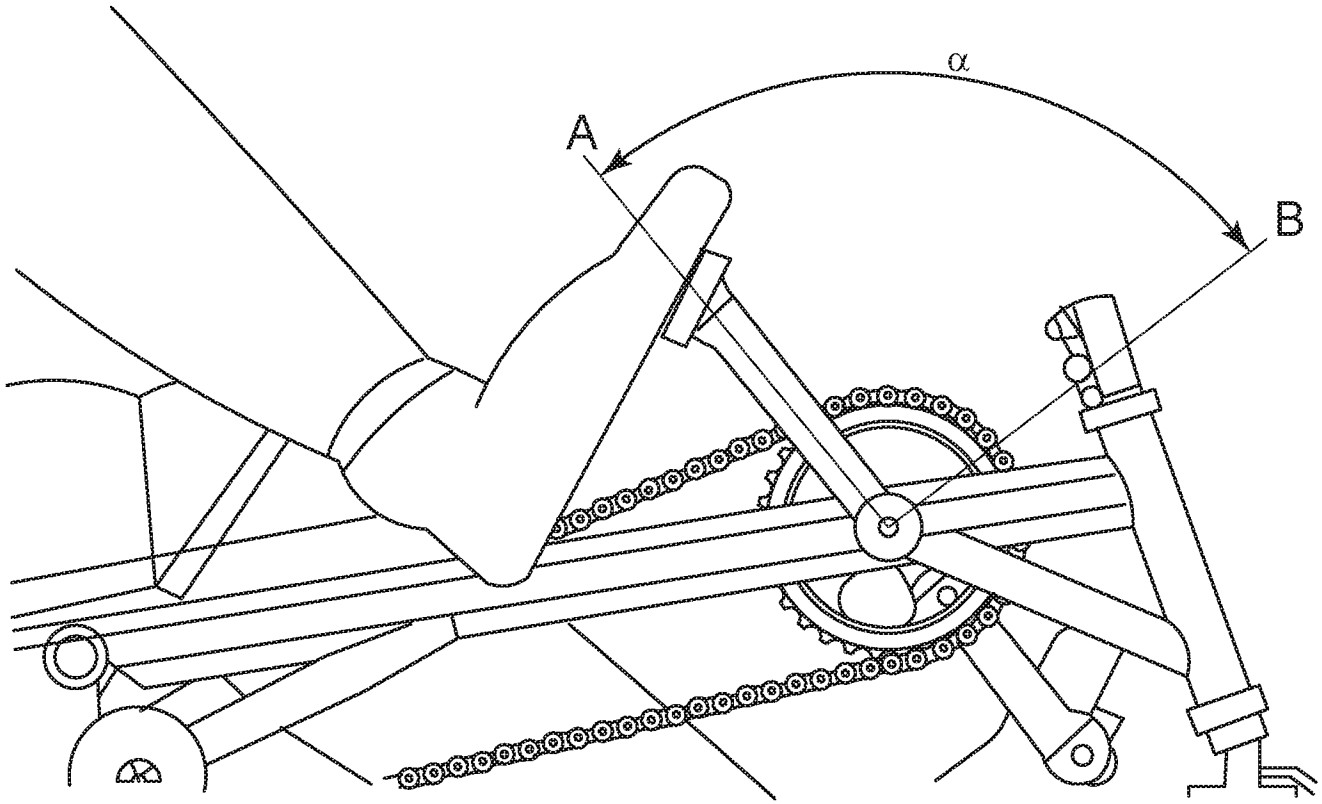
FIG. 3 illustrates an enlarged view of the crankset 10 of an embodiment of the invention.

With reference to FIG. 3, it is to be noted that, during the rotation of the pedals 11 about the rotational axis of the crankset 10, the force applied by the user will vary. It has been identified that over a radius of a, the force applied by the user is at a maximum. It will further be appreciated that during the range illustrated in FIG. 3, the force will reach an absolute maximum, likely when the force applied by the user's foot is substantially perpendicular to the longitudinal axis of the crank arms 12.

Preferably, the watercraft 1 is configured such that the hydrofoil 4 is on a downward stroke when a respective pedal 11 is passing between points A and B illustrated in FIG. 3. This is so as to align the part of maximum applied user force with the downward stroke of the hydrofoil 4. As noted above, the watercraft 1 is preferably configured such that for each complete revolution of a respective pedal 11 about the rotational axis of the crankset 10, the hydrofoil 5 completes two oscillation cycles. A particular benefit of this arrangement is that the downstroke of the hydrofoil is always substantially aligned with the respective downstroke of one of the user's legs (because the pedals 11 are separated by 180 degrees).

The embodiments shown adopt manually powered drive means. This is not essential. In other embodiments, the drive means may be powered, for example by a combustion engine or electrical motor. In powered embodiments, the power means preferably exerts a substantially constant torque, such that the alignment of the power means with the stroke of the hydrofoil is not essential.

In one embodiment, the hydrofoil is configured to be pitch stable throughout an entire cycle (oscillation), and such that the angle of attack is the same throughout. As a result, the hydrofoil preferably provides lift substantially throughout the entire cycle (oscillation).

In some embodiments, the watercraft may not be naturally ('hydrostatically') buoyant. Accordingly, the watercraft may require the operation of the hydrofoil to provide additional lift to counteract the weight of the watercraft. Such a watercraft may be launched by attachment to another moving vessel, such that the lift from the hydrofoil can be generated to then allow independent operation of the watercraft. The watercraft may additionally or alternatively be provided with buoyancy means, which are initially in contact with water but come out of contact with the water (to reduce drag) when the hydrofoil generates sufficient lift.

In another embodiment of the present invention, the watercraft may be hydrostatically buoyant (e.g. a ship), or have controllable positive or negative buoyancy (e.g. a submarine), and the hydrofoil may be adopted primarily to provide forward thrust. In such an embodiment, the angle of attack of the hydrofoil may reverse with the direction of the stroke. For example, on a downstroke of the drive transfer arm, the hydrofoil may be adapted such that it maintains a stable positive angle of attack and on the upstroke of the drive transfer arm, the hydrofoil may be adapted such that it maintains a stable negative angle of attack. As a result, on the upstroke, the lift force of the hydrofoil will act downwardly, but this will be counteracted by the hydrostatic buoyancy of the watercraft.

In known 'flapping foil' propulsion systems, it is necessary to mechanically control the angle of attack of the foil throughout the stroke to maintain an angle of attack such that the foil generates thrust on both up and downstrokes. That requires a complicated mechanism to orient the foil to the flow at the desired angle of attack. Typically, the drive shaft produces a sinusoidal oscillation of the foil, and a second drive shaft or 4 bar linkage, or gearing system drives a sinusoidal oscillation of the orientation of the flapping hydrofoil relative to the drive shaft so that the flapping hydrofoil adopts an appropriate angle of attack for each stroke. The rotation of the hydrofoil relative to the drive shaft has to be large at low vehicle speeds (where flapping motion dominates the velocity) and low at high vehicle speeds (where vehicle speed dominates the flow velocity over the hydrofoil).

In an embodiment of the claimed invention in which the angle of attack of the hydrofoil reverses with the direction of the stroke, the hydrofoil naturally adopts a stable angle of attack relative to the flow at the hydrofoil (the combination of both flapping and vehicle velocity). An advantage of this is that the angle of attack of the foil is appropriate for propulsion independent of the speed of the vehicle or flapping rate of the foil. It also has the advantage that the foil naturally adjusts its angle of attack to compensate for disturbances of the vehicle due to turbulence, wave or vehicle motion. In purely thrusting implementations the pitch stability of the foil has to be set to be of opposite sense on the upstroke and downstroke (or on strokes to the left versus strokes to the right). This change in the angle of attack may be implemented using flaps on the trailing edge of the hydrofoil, so that on a downstroke (or stroke to the right) the tip flaps go up and the centre flap goes down (or the tip flaps go left and the centre flaps go right), while on an upstroke (or stroke to the left) the flaps are reversed (tip flaps down or left, centreline flaps up or right).

In such thrust-only implementations, the drive foil flaps up and down such that the force generated on the downstroke is forwards and upwards, and on the upstroke it is forwards and downwards, ie the foil rotates a long way between up and downstrokes, particularly at low speeds. At zero speed the foil will rotate approximately 160 degrees between up and downstrokes. At high speed it might rotate only 45 degrees between up and downstrokes.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A watercraft comprising:

a chassis;

a drive, a hydrofoil; and a drive transfer arm, wherein the drive is operatively connected to a first end of the drive transfer arm, and the hydrofoil is pivotably connected to a second end of the drive transfer arm, the watercraft configured such that operation of the drive causes the hydrofoil to oscillate, to provide thrust, wherein the hydrofoil is pivotably connected to the second end of the drive transfer arm with an adjustable connection mechanism, wherein the distance between a leading edge of the hydrofoil and a rotational axis of a pivoting connection point to the drive transfer arm is adjustable.

2. A watercraft according to claim 1, wherein the watercraft is configured such that operation of the drive causes the hydrofoil to oscillate, to provide both thrust and vertical lift.

3. A watercraft according to claim 1, further comprising a control member, operable to adjust the distance between a leading edge of the hydrofoil and the rotational axis of a pivoting connection point to the drive transfer arm.

4. A watercraft according to claim 1, wherein the drive is a rotary drive.

5. A watercraft according to claim 1, wherein the drive is manually operated by the user of the watercraft.

6. A watercraft according to claim 5, wherein the manual drive includes a crankset provided with pedals.

7. A watercraft according to claim 6, wherein the drive further includes a drive wheel operatively connected to the crankset, wherein the drive wheel is operatively connected to the first end of the drive transfer arm.

8. A watercraft according to claim 7, further comprising a gear arrangement between the drive wheel and the crankset.

9. A watercraft according to claim 6, configured such that for each complete revolution of a pedal about the crankset, the hydrofoil completes two oscillation cycles.

10. A watercraft according to claim 1, wherein the drive includes a rotary drive wheel, and the watercraft further comprises a connecting rod, wherein a first end of the connecting rod is pivotably connected to the rotary drive wheel at a predetermined distance from the axis of rotation of the rotary drive wheel, and a second end of the connecting rod is pivotably connected to the first end of the drive transfer arm, wherein rotation of the rotary drive wheel causes the second end of the drive transfer arm to prescribe said arcuate path.

11. A watercraft according to claim 1, wherein the hydrofoil is substantially pitch stable.

12. A watercraft according to claim 1, wherein the hydrofoil comprises at least one controllable flap.

13. A watercraft according to claim 1, wherein a first end of the drive transfer arm is pivotably secured to the chassis, such that a second end of the drive transfer arm prescribes an arcuate path in use.

14. A watercraft according to claim 13, further comprising a support arm rigidly connected at a first end to the drive transfer arm and pivotably connected at a second end to the chassis, such that the drive transfer arm is rotatable about an axis passing through the pivoting connection of the support arm to the chassis.

15. A watercraft according to claim 1, further comprising a spring operatively connected between the chassis and the first end of the drive transfer arm.

16. A watercraft according to claim 1, wherein the rotation of the hydrofoil relative to the longitudinal axis of the drive transfer arm is limited to within a predetermined range.

17. A watercraft according to claim 1, wherein the hydrofoil is a self-stable reflexed hydrofoil, and/or has a non-uniform angle of incidence across its span.

18. A watercraft according to claim 1, further comprising at least one auxiliary hydrofoil attached to the chassis, for providing lift.

* * * * *